US012760391B1

(12) United States Patent
Caro et al.

(10) Patent No.: US 12,760,391 B1
(45) Date of Patent: Oct. 13, 2026

(54) SYSTEMS AND METHODS FOR ON/OFF LEACHING OF A HEAP

(71) Applicant: FREEPORT MINERALS CORPORATION, Phoenix, AZ (US)

(72) Inventors: Cristian Alejandro Caro, Tucson, AZ (US); Adam John Leonard, Calama (CL); Vladimir Antonio Ancasi Huisa, Thatcher, AZ (US)

(73) Assignee: FREEPORT MINERALS CORPORATION, Phoenix, AZ (US)

( * ) Notice: Subject to any disclaimer, the term of this patent is extended or adjusted under 35 U.S.C. 154(b) by 0 days.

(21) Appl. No.: 19/333,143

(22) Filed: Sep. 18, 2025

(51) Int. Cl.
*C22B 15/00* (2006.01)
*C22B 3/04* (2006.01)

(52) U.S. Cl.
CPC ..... *C22B 15/0065* (2013.01); *C22B 3/04* (2013.01)

(58) Field of Classification Search
CPC ..... C22B 15/0065; C22B 3/04
See application file for complete search history.

(56) References Cited

U.S. PATENT DOCUMENTS

| | | | | |
|---|---|---|---|---|
| 6,743,276 | B1 * | 6/2004 | Lane | C22B 3/02 75/712 |
| 10,041,143 | B2 * | 8/2018 | Rautenbach | C25C 1/12 |
| 10,480,046 | B2 * | 11/2019 | Eksteen | C22B 3/165 |
| 12,288,169 | B2 | 4/2025 | Geislinger et al. | |

FOREIGN PATENT DOCUMENTS

| | | |
|---|---|---|
| WO | 2025012848 | 1/2025 |
| WO | 2025156004 | 7/2025 |

OTHER PUBLICATIONS

C. Caro et al., "Leaching Low Grade Chalcopyrite from Run-of-Mine Stockpiles" COBRE 2013 Conference hosted by IIMCh, Proceedings of Copper 2013, Santiago, Chile.

J. M. Ekenes et al., "Improving Leaching Recovery of Copper from Low-Grade Chalcopyrite Ores", SME 2012.

J. M. Ekenes et al., "Improving Leaching Recovery of Copper from Low-Grade Chalcopyrite Ores", Minerals & Metallurgical Processing, Aug. 2013, vol. 30, No. 3, pp. 180-185.

C. Caro et al., "Application of the engineered heap process at Freeport-McMoran leaching operations" Hydroprocess 2012, 4th International Seminar on Process Hydrometallurgy, Jul. 2012, Santiago, Chile.

* cited by examiner

*Primary Examiner* — Sally A Merkling
*Assistant Examiner* — Nazmun Nahar Shams
(74) *Attorney, Agent, or Firm* — Snell & Wilmer LLP

(57) ABSTRACT

Methods for recovering a metal value from a metal-bearing material are provided. The method comprises intermittent application of a heated leaching solution to a plurality of regions of the metal bearing material followed by a period of time where no additional heating leaching solution is applied. This method results in a cyclical heating pattern that improves recovery of the metal value with reduced energy and reagent expenditure.

20 Claims, 3 Drawing Sheets

SYSTEMS AND METHODS FOR ON/OFF LEACHING OF A HEAP

FIELD OF INVENTION

The present disclosure generally relates to recovering metal values from metal-bearing materials, and specifically to leaching methods and systems for strategically increasing temperature of the heap to improve metal value recovery.

BACKGROUND

Advances in leaching technology have made it possible to recover copper values from copper sulfides, such as, for example, chalcopyrite, chalcocite and covellite, mixed copper oxide-sulfide, and copper bearing-clay minerals. Copper sulfides are generally more challenging to leach using traditional leaching practices, as their refractory nature makes it more difficult to break the mineral matrix and free the copper value.

Although leaching methods comprising, for example, application of acid and various reagents (e.g. oxidants), are relatively effective at metal extraction, implementing improvements to traditional processing techniques to increase extraction efficiency is economically advantageous. One such improvement found to be effective is increasing the temperature within a heap comprising metal-bearing material comprising metal values. In many heap leaching operations, temperature has been proven to accelerate kinetics and increase metal value extraction. The effect of temperature in metal value leaching from a heap is well studied in literature and has also been evaluated through modeling, leaching column test work, and in actual operations. The incremental recovery gain from temperature is mineralogically dependent, where harder to leach ores benefit the most (e.g., chalcopyrite). Several methods to increase temperature within a heap have been proposed, such as, for example, the use of covers to retain heat and/or additives that that may directly or indirectly improve leaching conditions.

In order to maximize metal value recovery and achieve the full benefit from the temperature within a heap, several approaches employ what are believed to be ideal operational conditions and best practices such as low application rates, air injection, healthy chemistry (free acid in the PLS), the use of stockpile covers to retain heat and/or additives that may directly or indirectly improve leaching conditions. For decades, tests have been carried out highlighting increased metal value recovery with higher temperatures. However, applying temperature to the whole leaching solution is cost prohibited and operationally challenging. Therefore, there remains a particular need for leaching methods for managing temperature addition and points of addition during the leaching cycle to maximize metal value recovery.

SUMMARY

In general, the present disclosure relates to methods and systems for recovering metal values from metal-bearing materials and, more specifically, to leaching methods and systems using periods of heat addition and periods of rest to leach a sulfide ore. In particular, the present disclosure addresses the need to manage temperature addition through cyclical management of heat addition and resting periods to areas of a heap.

There is provided for herein, in several embodiments, methods comprising applying a first amount of leaching solution heated to above an ambient temperature to a first portion of a metal-bearing material followed by a resting period to produce a first pregnant leaching solution to produce a PLS. In accordance with various embodiments of the present disclosure, the PLS is collected for further processing.

In various embodiments, the method further comprises applying a second amount of leaching solution heated to above an ambient temperature to a second portion of the metal-bearing material followed by a resting period to produce a second PLS. In accordance with various embodiments of the present disclosure, the first PLS and second PLS are collected for further processing.

In some embodiments, the metal-bearing material is configured in a heap. The heap, in some embodiments is a large, substantially flat-topped pile or stack of crushed ore with sloped sides. The heated leaching solution provided for herein is applied to one or more regions of the heap. In several embodiments, where a plurality of regions is involved, each region can be at any position within the heap. Heated leaching solution can be applied to a first region, followed by a second (and optionally subsequent region(s)) in any pattern desired. The regions can be overlapping and the pattern can be in a longitudinal or transverse direction down or across the heap surface. The first and second (and optionally subsequent region(s)) can be adjacent and the pattern can be in a longitudinal or transverse direction down or across the heap surface. The first and second (and optionally subsequent region(s)) can be spaced apart from one another and the pattern can be in a longitudinal or transverse direction down or across the heap surface. In various embodiments, the heated leaching solution is added to a heap leach at above-ambient temperatures. Such solution application is more efficient when a resting period is implemented followed by an additional application of heated leaching solution. This cyclical application period and resting period provides a lower-cost alternative to traditional leaching solution application methods which require more leaching solution to be heated at one time and more heated leaching solution to be applied.

In an exemplary embodiment, a method for enhanced recovery of a metal value from a metal-bearing material is provided. In various embodiments, the method comprises, applying a first amount of a heated leaching solution to a first region of the metal-bearing material comprising the metal value, wherein the first amount of the heated leaching solution is heated using an external heat source to a temperature above an ambient temperature of the first region of the metal-bearing material, wherein application of the first amount of the heated leaching solution elevates the temperature of the metal-bearing material in an area that comprises the first region to a temperature that is greater than the sum of the ambient temperature of the area that comprises the first region of the metal-bearing material and an anticipated amount of heat generated from a reaction between the first amount of the heated leaching solution and the first region of the metal-bearing material, waiting for a first period of time, wherein, during the first period of time at least a portion of the metal value in the first region of the metal-bearing material is leached into the first amount of the heated leaching solution to create a first amount of a pregnant leaching solution, wherein no additional heated leaching solution is applied to the first region of the metal-bearing material during the first period of time, wherein the total amount of metal value contained in collected portions of the pregnant leaching solution is greater than that collected from a first region of metal-bearing material comprising an equivalent metal value that is exposed to a leaching solution that is not heated to the temperature of the first amount of heated leaching solution, thereby enhancing recovery of the metal value.

In various embodiments, the method further comprises measuring an amount of the metal value within the pregnant leaching solution. In various embodiments, the method further comprises applying an additional amount of heated leaching solution to the first region of the metal-bearing material when a concentration of less than 1 gram per liter of the metal value within the pregnant leaching solution is measured.

In various embodiments, the method further comprises applying a second amount of a heated leaching solution to a second region of the metal-bearing material comprising the metal value, wherein the second amount of the heated leaching solution is heated using an external heat source to a temperature above an ambient temperature of the second region of the metal-bearing material, wherein application of the second amount of the heated leaching solution elevates the temperature of the metal-bearing material in an area that comprises the second region to a temperature that is greater than the sum of the ambient temperature of the area that comprises the second region of the metal-bearing material and an anticipated amount of heat generated from a reaction between the second amount of the heated leaching solution and the second region of the metal-bearing material, waiting for a second period of time, wherein, during the second period of time at least a portion of the metal value in the second region of the metal-bearing material is leached into the second amount of the heated leaching solution to create a second amount of pregnant leaching solution, wherein no additional heated leaching solution is applied to the second region of the metal-bearing material during the second period of time, collecting at least a portion of the first amount of pregnant leaching solution and the second amount of pregnant leaching solution and optionally combining the first amount and the second amount collected, and wherein the total amount of metal value contained in collected portions of the first and second pregnant leaching solutions is greater than that collected from a first and second region of metal-bearing material comprising an equivalent metal value that is exposed to a leaching solution that is not heated to the temperature of the first or the second amounts of heated leaching solution, thereby enhancing recovery of the metal value.

In various embodiments, the first amount of heated leaching solution is applied to the first region of the metal-bearing material for a plurality of days. In various embodiments, the first period of time is 30 days. In various embodiments, the first amount of heated leaching solution is heated to a temperature between 40 C and 50 C via an external heating source. In various embodiments, the second amount of heated leaching solution is applied to the second region of the metal-bearing material for a plurality of days. In various embodiments, the second period of time is 30 days.

In various embodiments, the second amount of heated leaching solution is heated to a temperature between 40 C and 50 C via an external heating source. In various embodiments, the first region of the metal-bearing material and the second region of the metal-bearing material are contained within a heap. In various embodiments, the first region of the metal-bearing material and the second region of the metal-bearing material overlap within a heap. In various embodiments, the first region of the metal-bearing material and the second region of the metal-bearing material are adjacent within a heap. In various embodiments, the first region of the metal-bearing material and the second region of the metal-bearing material are separated within a heap. In various embodiments, a metal of the metal-bearing material is copper.

In another exemplary embodiment, a method for enhanced recovery of a metal value from a metal-bearing material is provided. In various embodiments, the method comprises applying a first amount of a heated leaching solution to a first region of the metal-bearing material comprising the metal value, wherein the first amount of the heated leaching solution is heated using an external heat source to a temperature above an ambient temperature of the first region of the metal-bearing material, wherein application of the first amount of the heated leaching solution elevates the temperature of the metal-bearing material in an area that comprises the first region to a temperature that is greater than the sum of the ambient temperature of the area that comprises the first region of the metal-bearing material and an anticipated amount of heat generated from a reaction between the first amount of the heated leaching solution and the first region of the metal-bearing material, waiting for a period of time between about 30 and about 60 days, wherein, during the period of time at least a portion of the metal value in the first region of the metal-bearing material is leached into the first amount of the heated leaching solution to create a first amount of a pregnant leaching solution, wherein no additional heated leaching solution is applied to the first region of the metal-bearing material during the period of time, and wherein the total amount of metal value contained in collected portions of the pregnant leaching solution is greater than that collected from a first region of metal-bearing material comprising an equivalent metal value that is exposed to a leaching solution that is not heated to the temperature of the first amount of heated leaching solution, thereby enhancing recovery of the metal value.

In another exemplary embodiment, a method for enhanced recovery of a metal value from a metal-bearing material is provided. In various embodiments, the method comprises applying a first amount of a heated leaching solution to a first region of the metal-bearing material comprising the metal value, wherein the first amount of the heated leaching solution is heated using an external heat source to a temperature between about 40 and about 50 degrees Celsius, wherein the first amount of heated leaching solution is applied over a period time of about 30 to about 60 days at a rate of between about 5 liters per hour per square meter and about 10 liters per hour per square meter, wherein application of the first amount of the heated leaching solution elevates the temperature of the metal-bearing material in an area that comprises the first region to a temperature that is greater than the sum of an ambient temperature of the area that comprises the first region of the metal-bearing material and an anticipated amount of heat generated from a reaction between the first amount of the heated leaching solution and the first region of the metal-bearing material, terminating application of the heated leaching solution, waiting for a period of time between about 30 and about 60 days, wherein no additional heated leaching solution is applied to the first region of the metal-bearing material during the period of time, wherein, during the application and waiting periods, at least a portion of the metal value in the first region of the metal-bearing material is leached into the first amount of the heated leaching solution to create a pregnant leaching solution, optionally repeating the application, termination, and waiting steps a plurality of times, and collecting the pregnant leaching solution, wherein the total amount of metal value contained in collected portions of the pregnant leaching solution is greater than that collected from a first region of metal-bearing material comprising an equivalent metal value that is exposed to a leaching solution that is not heated to the temperature of the first amount of heated leaching solution, thereby enhancing recovery of the metal value and/or wherein energy and reagent expenditure is less than energy and reagent expenditure realized when heated leaching solution is constantly applied to the metal-bearing material for an equivalent period of time.

BRIEF DESCRIPTION OF THE DRAWINGS

The subject matter is pointed out with particularity and claimed distinctly in the concluding portion of the specification. A more complete understanding, however, may best be obtained by referring to the detailed description and claims when considered in connection with the following drawing figures.

DETAILED DESCRIPTION

Figure 1:
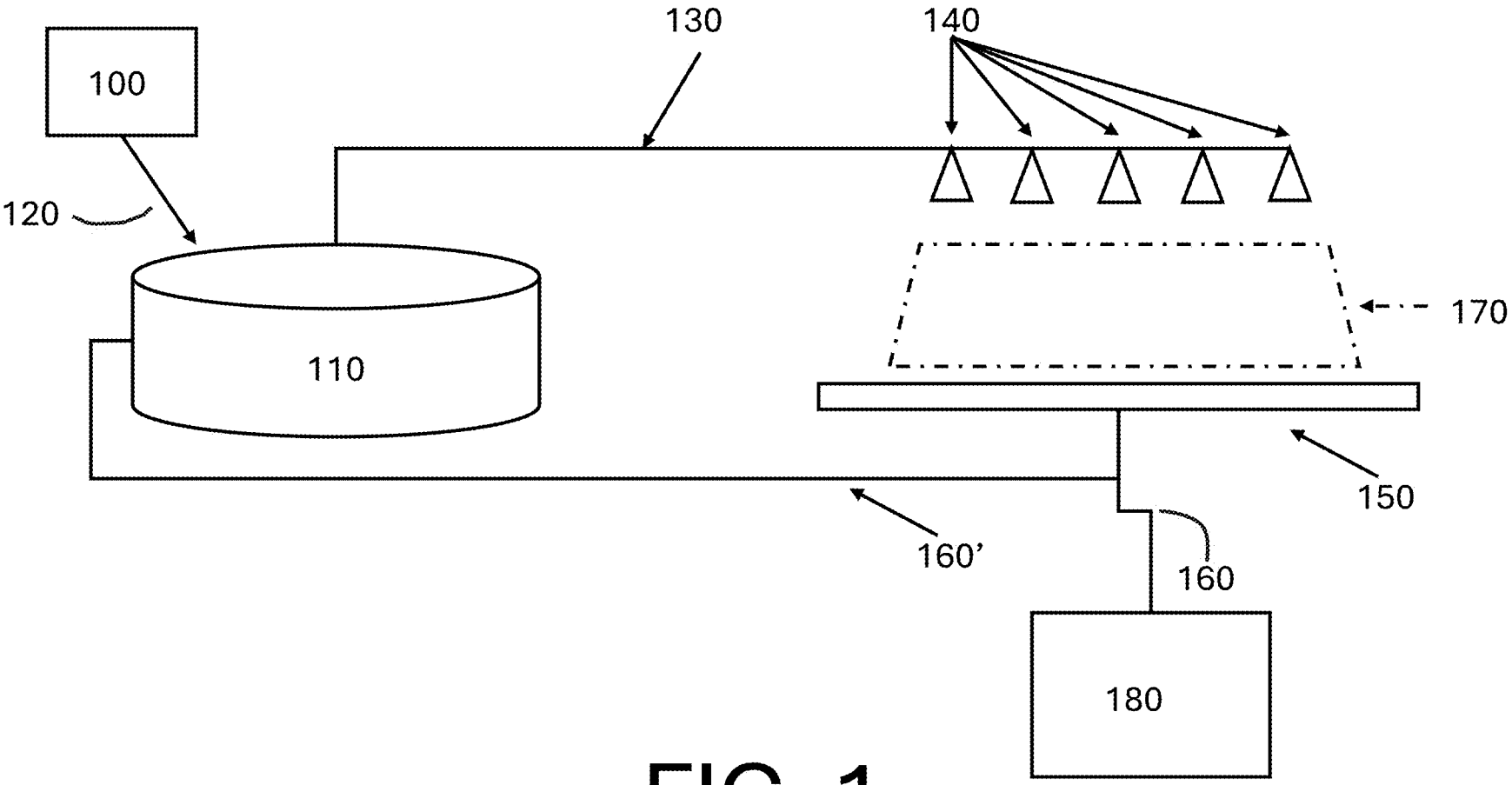
FIG. 1 illustrates various embodiments of methods and systems for recovering metal values from metal-bearing materials in accordance with the present disclosure.

The detailed description of exemplary embodiments makes reference to the accompanying drawings, which show exemplary embodiments by way of illustration and their best mode. While these exemplary embodiments are described in sufficient detail to enable those skilled in the art to practice the invention, it should be understood that other embodiments may be realized and that logical, chemical, and mechanical changes may be made without departing from the spirit and scope of the inventions. Thus, the detailed description is presented for purposes of illustration only and not of limitation. For example, unless otherwise noted, the steps recited in any of the method or process descriptions may be executed in any order and are not necessarily limited to the order presented. Furthermore, any reference to singular includes plural embodiments, and any reference to more than one component or step may include a singular embodiment or step. Also, any reference to attached, fixed, connected or the like may include permanent, removable, temporary, partial, full and/or any other possible attachment option. Additionally, any reference to without contact (or similar phrases) may also include reduced contact or minimal contact.

As used herein, the acronym ROM refers to "run of mine," which is ore in its unprocessed state before agglomeration or leaching. ROM is not limited to mined rock but also includes blasted or crushed material.

As used herein, the term "metal value" refers to an elemental metal having at least some commercial/monetary value. In various embodiments, a metal value may comprise copper, nickel, zinc, silver, gold, germanium, lead, arsenic, antimony, chromium, molybdenum, rhenium, tungsten, iron, ruthenium, osmium, cobalt, rhodium, iridium, palladium, platinum, uranium, or rare earth metals.

As used herein, the term "metal-bearing material" refers to any substance comprising a metal value that can be removed at least to some degree by leaching. In various embodiments, a metal-bearing material comprises an ore, a concentrate, a process residue such as leached ore, or a blend of leached ore and newly mined ore, or various combinations thereof. In various embodiments, a metal-bearing material comprises a copper-bearing material. In various embodiments, a metal-bearing material comprises chalcocite, pyrite, chalcopyrite, arsenopyrite, bornite, covellite, digenite, cobaltite, enargite, galena, greenockite, millerite, molybdenite, orpiment, pentlandite, pyrrhotite, sphalerite, stibnite, and/or any other suitable metal-bearing ore material, and mixtures thereof. In various embodiments, a metal-bearing material comprises a primary or secondary sulfide such as chalcocite, bornite, pyrite, or chalcopyrite, or a blend thereof.

In the detailed description, references to "various embodiments", "one embodiment", "an embodiment", "an example embodiment", etc., indicate that the embodiment described may include a particular feature, structure, or characteristic, but every embodiment may not necessarily include that feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

In general, the present disclosure relates to methods and systems for recovering metal values from metal-bearing materials and, more specifically, to leaching methods and systems by heating a leaching solution and applying it to a heap for a period followed by a resting period. In various embodiments, a method for recovering a metal value from a metal-bearing material includes leaching a metal-bearing material with heated leaching solution comprising a raffinate and at least one leaching beneficial reagent to produce a pregnant leaching solution and a leached material. In various embodiments, the at least one leaching beneficial reagent may comprise citric acid (or salts thereof), chloride, an oxidant (e.g. hydrogen peroxide), a glucose derived acid, or any other reagent known to improve leaching. The raffinate may also contain an oxidant.

In various embodiments, leaching methods provided for herein comprise heap leaching. Heap leaching provides a low-cost method of extracting metal values from relatively low-grade metal-bearing materials and has found application in the processing of metal-bearing ores. In various embodiments, a method for recovering a metal value from a metal-bearing material further comprises leaching the heap with a leaching solution comprising the raffinate and the citric acid or salt thereof to produce a PLS and a leached material In various embodiments, an ore is mined, crushed, and then transported to a heap location where it is stacked onto a pad. In various embodiments, the crushed ore goes through a particle size enhancement process called agglomeration to improve leaching efficiency before it is transported to the heap. A suitable acidic solution is dispensed onto the heap, and the resulting leach solution trickles slowly through the heap under the force of gravity to the pad. This pad typically has a sloped base to allow the solution to flow into collection drains for further processing, such as by a conventional, solvent extraction/electrowinning (SX/EW) process or a direct electrowinning (DEW) process.

In various embodiments, ore may be first subjected to the energy intensive processes of crushing and agglomeration, after which a high percentage of the contained valuable metal can be extracted by the leaching methods disclosed herein. However, when ores do not contain enough recoverable copper to make crushing and agglomeration economic, the ore may be dumped by haul trucks onto leach dumps. The particle size distribution of this run-of-mine (ROM) ore is much larger than crushed ore with P80 sizes between 6 and 12 inches.

In various embodiments, agglomeration comprises placing a metal-bearing material in contact with an agglomeration solution on the order of about 0 to about 30 days, preferably on the order of about 1 to 10 days, more preferably at least 2 days. In other embodiments, agglomeration is optionally performed for longer than 30 days.

In various embodiments, the agglomeration solution may comprise an oxidant and citric acid or salts thereof. In various embodiments, the agglomeration solution comprises a concentration of an oxidant on the order of about less than about 10% by weight, preferably on the order of about 1% to about 6% by weight, more preferably on the order of about 4% to about 6% by weight. In various embodiments, an agglomeration solution comprises citric acid or salt thereof at less than about 20 grams per liter, or between 2 grams and 10 grams per liter of agglomeration solution.

In various embodiments, after the agglomeration, the agglomerated metal-bearing material is subjected to leaching. In other embodiments, the metal-bearing material may bypass agglomeration and proceed directly to leaching after crushing. In various embodiments, the leaching of a metal-bearing material comprises contacting an agglomerated metal-bearing material with a leaching solution to obtain a PLS.

In various embodiments, the duration of leaching may be on the order of about 0 to about 50 days, preferably on the order of about 10 to about 45 days, more preferably for a duration on the order of at least 15 days followed by a resting period. In various embodiments, the resting period is approximately equivalent to the leaching period. In various embodiments, the resting period is equal to the leaching period. In various embodiments, the resting period is longer than the leaching period. In various embodiments, the resting period is shorter than the leaching period. In various embodiments, a cycle of leaching and resting may be continued for as long as is practically or economically feasible, such as on the order of about a year.

In various embodiments, the leaching solution may comprise an acid, an oxidant, and citric acid or salts thereof. In various embodiments, leach solutions used herein comprise sulfuric acid, hydrogen peroxide, and citric acid or a suitable citrate salt thereof. In various embodiments, a leaching solution may comprise a concentration of citric acid or salt thereof on the order of less than about 20 g/l, preferably in the range of about 0.005 g/l to less than about 10 g/l, and more preferably on the order of about 0.1 g/l.

In various embodiments, after leaching, the PLS may proceed to metal recovery. In various embodiments, metal recovery may comprise a solvent extraction and electrowinning (SX/EW) process, or a direct electrowinning (DEW) process to obtain the metal value from the PLS and produce the raffinate.

In contrast to the secondary copper sulfides such as chalcocite and covellite, copper is more tightly bound to iron and sulfur within the mineral lattice of primary copper sulfide ores such as chalcopyrite. Although much work is currently being performed to leach chalcopyrite bearing minerals, generally leach recovery from these minerals is low (e.g., around 15% of the contained copper over hundreds of days of leaching). This usually results in these minerals being sent to froth flotation and smelting. However, some chalcopyrite may be placed on leach stockpiles, either because the chalcopyrite is mixed with other (more leachable) minerals or because the chalcopyrite is contained in ore whose copper grade was too low (below mill cutoff-grade) to be processed economically via the froth flotation and smelting method. The leach recovery from chalcopyrite minerals may be improved by using leach additives (of various chemical classes) to leach solutions or by adding the solutions directly to the ore. Oxygen or an oxidant of some type must also be present and available at the mineral surfaces to be leached.

Temperature is a factor in the leaching of both secondary sulfides and primary sulfides. Temperature may increase metal recovery on the order of, for example, 0.5% for every 1° C. in temperature, provided sufficient oxygen is present for the oxidation reactions to proceed. Such increases in recovery may be impacted by several considerations, variable ranges, and practical limits. While temperature may be increased by heating surrounding or applied air or and/or chemical reactions occurring within the leach stockpile (e.g., the oxidation of pyrite) the temperature may also increase due to increasing the temperature of applied leach solutions. In various embodiments, the chemical reactions occurring within the leach stockpile may be exothermic or endothermic reactions.

In various embodiments, methods for recovering metal values from a metal-bearing material comprises any one or combination of heap leaching, subsurface leaching, deep leaching, column leaching, shake flask leaching, or tank leaching. In certain configurations, for example, a heap leach operation can include surface leaching (such as by drip emitters and/or wobblers) and subsurface and/or deep leaching (such as by injection into the heap, including deep injection of raffinate in a process called "deep-raff injection").

If it is determined that the existing mineralogy is amenable to heap leaching, and other economic conditions are favorable, ore is placed on stockpiles in preparation for leaching. Optimization of ore placement may maximize the profit from a leach operation. Ores that have a high enough copper grade, favorable leach recovery and favorable days under leach (e.g., kinetics) may be crushed and agglomerated prior to conveyor stacking on a leach pad. In these circumstances, the amount of copper that is projected to be recovered via leaching from the ore is more than sufficient to cover the costs of haulage and crushing to a P80 size of less than about 1" (and often with a P80 of <¾" or <½"). The P80 size of an ore size distribution is a measure of particle size distribution having the screen size through which 80% of the particles may pass. The crushed ore may be conveyed into a large, rotating agglomeration drum, where the ore is mixed and wetted with at least one of (or a mixture of) water, reclaimed water, brine, raffinate, Intermediate Leach Solution (ILS), pregnant leach solution (PLS), sulfuric acid, another metal bearing product or products, an auxiliary oxidant, a halide salt, a binder, one or more additives to enhance galvanic leaching or generate heat such as pyrite or a pyrite bearing material, a chelating agent, an organic acid, or other leach additives. One purpose of agglomeration is to attach fine particles to coarser particles so that the particles do not migrate through the stockpile and ultimately cause the permeability of the structure to be decreased. Another purpose of agglomeration is to expose the ore to acid and lixiviants so that the leaching process is started. Yet another purpose of agglomeration is to create ore aggregates with optimum leaching characteristics.

After agglomeration, the ore is fed onto mobile stacking conveyors and deposited in a layer whose thickness (lift height) may be determined by the average leach characteristics of the ore being stacked (usually between 15-30 feet high). As the ore is stacked, an earthen structure is formed by the ore such that the top surface of the pad is relatively flat, while the sides (side slopes) of the pad are at the angle of repose of the damp ore.

After an area of the pad has been stacked with ore, an arrangement of leach lines (e.g., drip lines) may be placed on the top surface of the ore. Leach lines may also be placed on the side slopes of the leach pad structure so that the volume of ore around the sides of the pad is included in the leach operation. In other variations, leach lines are configured for subsurface and/or deep injection of leach solution. Leach solution, which may comprise a mixture of raffinate, ILS, PLS, water, sulfuric acid, auxiliary oxidant, and a leach enhancing additive, is heated, including by UV radiation, external heat, or an external heating source such as mechanical heaters. The heat leach solution is then pumped through the leach lines, and dripped or sprayed onto the ore and/or injected subsurface or injected deep. For surface leaching, the choice of using drip emitters or sprayers (e.g., wobblers) to introduce leach solution to the ore depends on such factors as the mineralogy of the ore. Sulfide ores have improved recovery when leach solution application rates are low, so drip emitters may be preferred. Plant water balance issues also influence the choice. If, due to weather events, too much water has entered the leach system, sprayers can be used to aid in evaporation.

An operational issue that may occur when drip emitters are used is plugging. Wobblers are not as prone to plugging, so wobblers may be used if leach solutions contain suspended solids that are not economical to remove. Because leach pads are very large, it is difficult to know whether leach lines are plugged. Plugged leach lines may be an operational issue because the ore under and adjacent to those leach lines will not be exposed to leach solutions and thus will not produce copper.

In various configurations, a heap leach may be "double piped," that is, two sets of leach lines configured to a permanent heap. In this type of heap leach configuration, one line is dedicated to input of oxidant to the heap and another line is dedicated to input of a mixture of raffinate, sulfuric acid, and citric acid or salts thereof to the heap. This configuration ensures that the mixing of oxidant with the combination of raffinate, sulfuric acid, and citric acid or salts thereof occurs on the rock.

In various embodiments, a double-piped heap leach comprises a trickle-down supply of oxidant, such as for example, ≤30% purity hydrogen peroxide in one line and raffinate, citric acid or salts thereof, and an amount of sulfuric acid in the second line. The sulfuric acid in the second line can be freshly added, or the sulfuric acid that is recycled back in the raffinate obtained from solvent extraction/electrowinning (SX/EW) or other metal recovery process, so long as the amount of sulfuric acid is about 2 to about 20 pounds/ton of rock.

After the ore has been leached for a chosen number of days (days under leach or the leach cycle), the leach solution flow to a section of the leach pad may be shut off and the pad may be allowed to partially dry out during a resting period for a proscribed number of days (the resting period). In various embodiments, the leach solution flow may be turned on to a second location of the leach pad for a leach cycle.

Calculations used to determine the profitability of mining a particular section of ore depend not only on the properties of that ore (e.g., mineralogy, grade, leachability), but also on changing external factors of which leach operators and/or mine operators may have little control.

A variable cost is the cost of diesel fuel used by external heaters heating leaching solution and pumps controlling the flow of leaching solution. The price of this commodity causes swings in the costs of mining, and consequently, in the revenue that can be generated from each designated volume of ore. The cost of heating the leaching solution is the heating cost. The distance between leaching solution heating and the heap is the leach piping distance. The costs of heat leaching and heat piping distance are proportional to amount of leaching solution and piping distance, but also depend on factors such as mine topography. Heating and piping costs are a significant mining cost and depend on the cost of ambient temperature, pumps, heating containers, and pump maintenance costs.

Non-limiting ways to improve both the cost profile and carbon footprint of a mine is to passively re-leach ore containing metal values that may not have been recovered earlier due to, for example, the use of older and less optimized leaching techniques, and heating smaller amounts of leaching solution at a time. Such "old ore" may have lower contained value metals, such as copper, but it also bears limited costs as it has already been blasted, mined, transported, and stacked. The mineral values left behind in this "old ore" are likely to be largely primary sulfides and thus will require some type of enhanced leach method to recover copper or other metal values in an economically viable way. In various embodiments, "old ore" or remined ore may be combined with new ore for further processing.

The cost of sulfuric acid used for leaching is both significant and variable. Leach recovery may be highly dependent on exposing the ore to the optimum amount of leaching solution so that the copper is put into solution and iron precipitation is inhibited. Advantages of the use of cyclical application and resting in leaching methods according to the present disclosure are that it allows a smaller amount of leaching solution to be added to target areas of a heap and for more passive recovery of metal values.

In various embodiments of the present disclosure, a method for enhanced recovery of a metal value from a metal-bearing material comprises the steps of: (i) applying a first amount of heated leaching solution to a first region of a heap for a number of days to produce a pregnant leaching solution; (ii) stopping the flow of leaching solution for a number of days; (iii) recovering the metal value from the pregnant leaching solution; (iv) applying a second amount of heated leaching solution to a second region of the heap for a number of days to produce a second amount pregnant leaching solution; (v) stopping the flow of leaching solution for a number of days; and (vi) recovering the metal value from the second amount of pregnant leaching solution.

In other embodiments, a process for enhanced recovery of a metal value from a metal-bearing material includes the steps of: (i) forming a Run of Mine (ROM) heap (ii) heating a first amount of heating solution using an external heat source to a temperature above an ambient temperature the heap; (iii) applying the heated first amount of leaching solution to the heap for a number of days to produce a pregnant leaching solution; (iv) stopping the flow of leaching solution for a number of days; (v) recovering the metal value from the pregnant leaching solution; (vi) repeating (i)-(v) on a second region of the heap.

In various embodiments, metal values include, but are not limited to, copper, nickel, zinc, silver, gold, germanium, lead, arsenic, antimony, chromium, molybdenum, rhenium, tungsten, iron, ruthenium, osmium, cobalt, rhodium, iridium, palladium, platinum, uranium, or rare earth metals. More preferably, the metal values can be copper, nickel, and/or zinc. Most preferably, the metal value is copper.

While particular reference has been made herein to heating the leaching system through the use of a heated leaching solution, any method sufficient to heat a leaching system to increase leaching efficiency is within the scope of the present disclosure. For example, the use of heap covers, injected air and/or reagents designed to increase exothermic reactions, concentrated UV radiation, and/or external heat sources may be utilized within the disclosed methods and systems.

With reference now to FIG. 1, a schematic system for implementing application of heated leaching solution is illustrated. The system comprises a heating element 100 that is configured to apply heat 120 to leaching fluid contained within a storage vessel 110. The heating element 100 may apply constant heat to the leaching solution or run at a desired duty cycle to maintain the leaching solution within the storage vessel 110 at a relatively constant temperature (e.g., a temperature above the ambient temperature of a region of the heap to be leached). The storage vessel 110 is optionally insulated. A leaching solution delivery line 130 is fluidically coupled to the storage vessel 110 and is configured to deliver heated leaching solution to one or more dispensing units 140. The dispensing unit or units 140 may be located above, within, or under a heap 170 (shown in phantom as the heap does not comprise part of the system) and dispenses a desired amount of heated leaching solution to the heap at a desired flow rate and covering a desired area. The leaching solution delivery line 130 is optionally insulated to maintain the temperature (or reduce heat loss) of the heated leaching solution passing there through. The heated leaching solution may be pumped through the leaching solution delivery line 130 or can optionally be gravity fed. A collection pad 150 is positioned under the heap 170 and collects pregnant leaching solution (PLS). A pregnant leaching solution delivery line 160 functions to direct the collected pregnant leaching solution and convey it to a downstream processing center 180 (where a metal value is recovered from the pregnant leaching solution). Optionally a pregnant leaching solution recovery line 160' recycles at least a portion of the pregnant leaching solution back to the storage vessel 110 for reheating and reapplication to the heap 170.

Metal values, such as those described herein, may be recovered from the metal-bearing material. In various embodiments, metal-bearing material comprises any one or mixture of chalcocite, pyrite, chalcopyrite, arsenopyrite, bornite, covellite, digenite, cobaltite, enargite, galena, greenockite, millerite, molybdenite, orpiment, pentlandite, pyrrhotite, sphalerite, stibnite, and/or any other suitable metal-bearing ore material or concentrate. In various examples, the metal-bearing material is a primary or secondary sulfide such as chalcocite, bornite, pyrite, or chalcopyrite, or a blend of such mineral species.

In various embodiments, metal-bearing material comprises a copper sulfide ore, such as, for example, chalcopyrite ($CuFeS_2$), chalcocite ($Cu_2S$), bornite ($CusFeS_4$), covellite ($CuS$), enargite ($Cu_3AsS_4$), digenite ($Cu_9S_5$), and mixtures thereof.

In various examples, metal-bearing material comprises ore in any number of physical states. Before an ore deposit is mined, the ore is said to be in situ. During mining, the metal-bearing material may progress through multiple states as it is harvested, collected, transported, and processed. For example, the metal-bearing material as harvested at the mining site may often be referred to as run of mine (or "ROM") ore. ROM ore may be produced by, for example, blasting, open pit mining, and other surface and subterranean ore extraction techniques. As such, ROM ore includes ore of various sizes from ore as small as powder up to and including boulders. The metal-bearing material can comprise any of these physical states.

In various embodiments, all, or a portion of, the metal-bearing material is further processed via size classification and/or crushing to achieve a desired particle size distribution, such that substantially all the particles are of a size that allows for effective agglomeration of the metal-bearing material and allows for optimal economic recovery of the contained metal values.

In various embodiments, the metal-bearing material is characterized by any combination of particle size distributions. For example, the particle distribution may have a combination of fine and coarse particles. The conditions and parameters of the method disclosed herein may be adjusted to achieve an optimized result for leaching and metal recovery.

In various embodiments, the leaching solution is mixed prior to external heating. In various embodiments, leaching solution may be an aqueous product of a solvent extraction process, such as, for example, a conventional solvent extraction/electrowinning (SX/EW) process, or a direct electrowinning (DEW) process. In other words, leaching solution may be a product of the metal recovery process that also produces the metal value. In various embodiments, the leaching solution may comprise water and acid.

In various embodiments, an external heating process of the leaching solution comprises conducting an external heating process on the leaching solution in a storage vessel. In various embodiments, the external heating process of the leaching solution comprises exposing a storage vessel to solar or UV radiation for heating the leaching solution. A storage vessel may be any storage vessel known in the art. The leaching solution is heated to a temperature above the ambient temperature of the heap. In various embodiments, the leaching solution is heated near a heap so that it can, in various examples, be added directly from its heating location to a heap with a minimal loss of heat.

In various embodiments, the leaching process may be carried out in a leaching solution at a temperature of about 25° C. to about 60° C., preferably on the order of about 45° C.

In various embodiments, leaching process comprises applying a heated leaching solution to a heap containing metal-bearing material for about 0 to 30 days. In various embodiments, leaching process comprises applying a heated leaching solution to a heap containing metal-bearing material for about 30 to 60 days.

In various embodiments, the metal-bearing material may rest without heated leaching solution for any duration of time in the range of about 0 to about 30 days. In various embodiments, the metal-bearing material may rest without heated leaching solution for any duration of time in the range of about 30 to about 60 days.

In various embodiments, a leaching process comprises heap leaching. Heap leaching comprises stacking or forming agglomerated metal-bearing material and optionally other materials into a heap or a portion of a heap. In various embodiments, heap leaching comprises leaching a heap with heated leaching solution after the heap is formed. In various embodiments, heap leaching comprises stacking or forming non-agglomerated ROM metal-bearing material into a heap or portion of a heap. In various embodiments, the heap may be treated with a curing solution for a certain period and then subsequently leached with a heated leaching solution. In such embodiments, treating the heap with a curing solution may re-oxidize the leached material to render it amendable for further leaching. In various embodiments, the curing solution, may contain the raffinate, citric acid or salt thereof, and the oxidant.

In various embodiments, a leaching process comprises heap leaching with a plurality of sets of leach lines configured to a heap.

In various embodiments, a leaching process comprises heap leaching with a plurality of sets of independently operated leach lines configured to a plurality of regions of a heap.

EXAMPLES

A specimen of copper-containing ore was subject to a leaching method disclosed in the present application. The specimen contained 20% chalcopyrite. A series of trials were run on the ore over 120 days. During the trial, the leaching solution contained 6 gpl acid and 13 lb/t cure and was heated prior to leaching to 45° C. The heated leaching solution was applied to the ore at 8 L/h/m$^2$.

Figure 2:
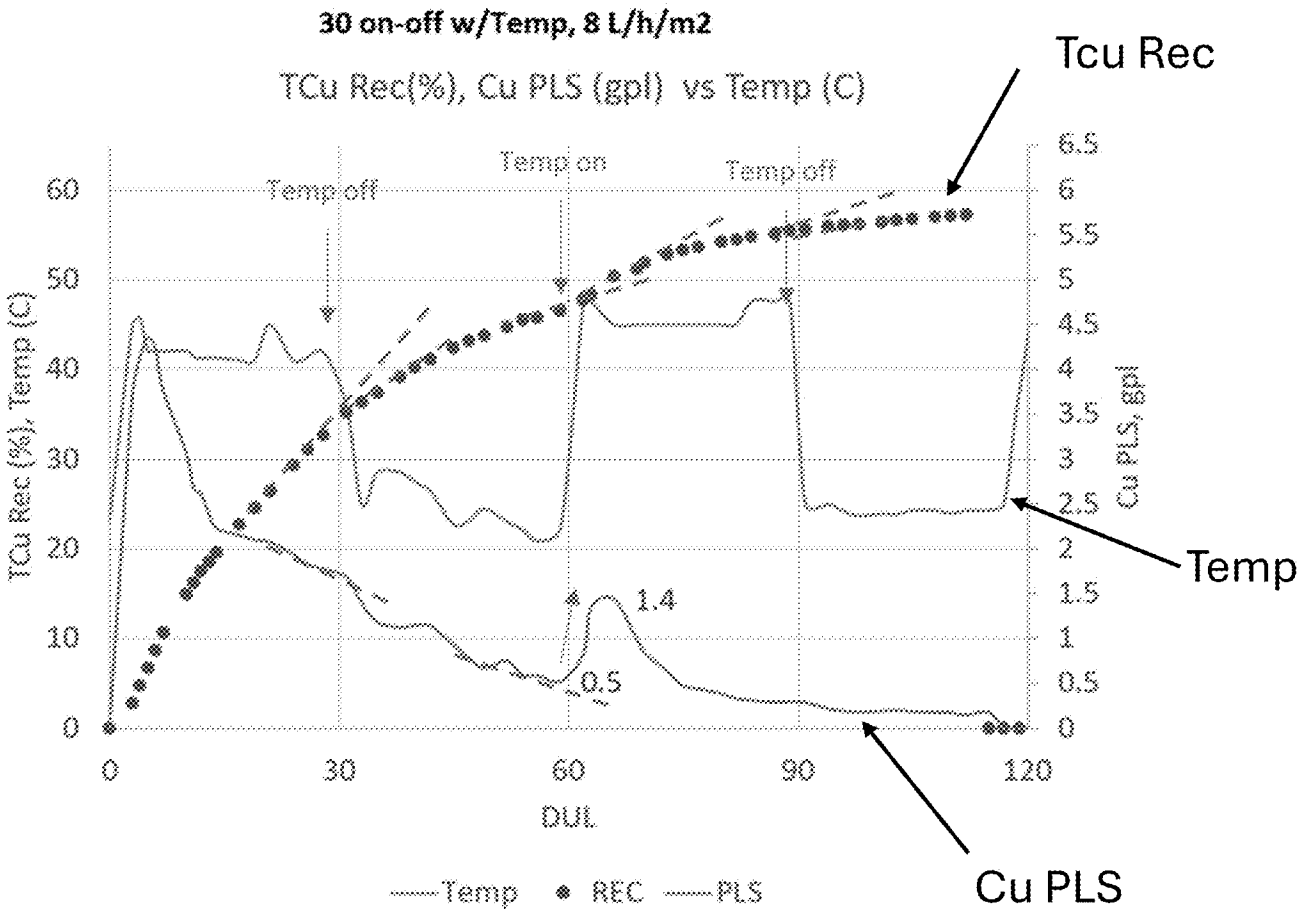
FIG. 2 illustrates data traces relating to the heat application cycle described in Example 1.

In Example 1, and as shown in FIG. 2, the heated leaching solution was applied for a series of cycles comprised of 30 days of application followed by 30 days of no application.

Figure 3:
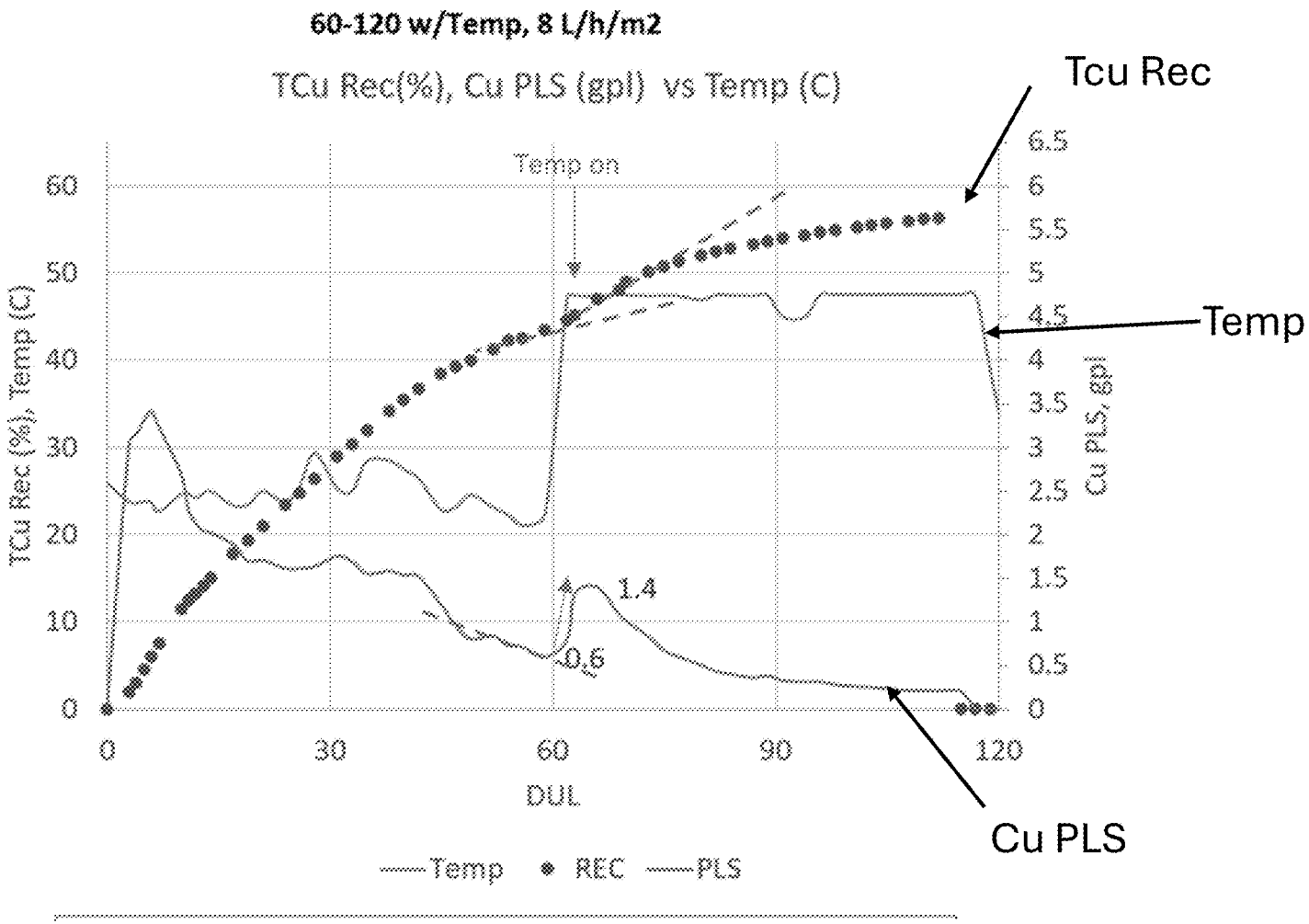
FIG. 3 illustrates data traces relating to the heat application cycle described in Example 2.

In Example 2, and as shown in FIG. 3, the heated leaching solution was applied during days 60-120.

As can be seen in FIGS. 2 and 3, total copper recovery (TCu Rec) and temperature are depicted on the Y axis on the left of the figure, while the concentration of copper in the pregnant leaching solution (Cu PLS) is depicted on the Y axis on the right of the figure. The X axis depicts the number of days under leaching conditions (DUL).

In FIG. 2, the application of heat in a 30-day on/30-day off cycle led to an increase in the temperature within the heap, as can be seen at the 60 to 90 day application period, which appears to be several degrees above the 0 to 30 day heat cycle. It appears that application at 120 days would have further increased the heap temperature at the temperature at 120 appears nearly equal to the 60-90 day temperature but with a steep slope (suggesting a greater temperature would have been reached). This incremental increase in heap temperature appeared to be correlated with a spike in the amount of copper in the PLS. This is represented by an increase from 0.5 g/L to 1.4 g/L at the inception of the 60-90 day application period. Copper recovery steadily increased throughout the DUL period, with apparent correlation of increased recovery and decreased recovery with application and removal of heat, respectively (indicated by the dashed lines on the TCu Rec curve). These data suggest that the application of heat (even if over a period of 30 days) leads to greater copper recovery, with the total copper recovery at 120 days of about 5.6%. However, the intermittent application of heated leaching solution is paired with a decrease in the energetic costs compared to constant application of heated leaching solution (both in terms of heating the leaching solution and use of the solution itself).

Similar data is shown in FIG. 3, wherein heated leaching solution was applied from day 60. The amount of copper recovery increased concurrently with the application of the heated solution (note the slope of the two dashed lines at 60 days on the TCu Rec curve. This is also shown in the Cu PLS curve with an increase from 0.6 to 1.4 g/L. Copper recovery steadily increased from 60 to 120 days (matched by a decline in the Cu PLS concentration) reaching a total of about 5.6%.

Collectively these data show that heated leaching solution can improve the copper recovery while being associated with lower energetic demands compared to constantly applying heated leaching solution, leading to increased energetic efficiency in the leaching process.

In summary, the present disclosure sets forth methods and systems for obtaining metal values from metal bearing materials, the method utilizing a cyclic period of applying heated leaching solution followed by rest to improve the efficiency of metal extraction operations. In accordance with the various embodiments of the present disclosure, the described processes increase metal value yield compared with conventional methods and systems.

Steps recited in any of the method or process descriptions may be executed in any order and are not necessarily limited to the order presented. Furthermore, any reference to singular includes plural embodiments, and any reference to more than one component or step may include a singular embodiment or step. Also, any reference to attached, fixed, connected, coupled or the like may include permanent (e.g., integral), removable, temporary, partial, full, and/or any other possible attachment option. Any of the components may be coupled to each other via friction, snap, sleeves, brackets, clips or other means now known in the art or hereinafter developed. Additionally, any reference to without contact (or similar phrases) may also include reduced contact or minimal contact.

Benefits, other advantages, and solutions to problems have been described herein with regard to specific embodiments. However, the benefits, advantages, solutions to problems, and any elements that may cause any benefit, advantage, or solution to occur or become more pronounced are not to be construed as critical, required, or essential features or elements of the disclosure. The scope of the disclosure is accordingly to be limited by nothing other than the appended claims, in which reference to an element in the singular is not intended to mean "one and only one" unless explicitly so stated, but rather "one or more." Moreover, where a phrase similar to 'at least one of A, B, and C' or 'at least one of A, B, or C' is used in the claims or specification, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C.

All structural, chemical, and functional equivalents to the elements of the above-described various embodiments that are known to those of ordinary skill in the art are expressly incorporated herein by reference and are intended to be encompassed by the present claims. Moreover, it is not necessary for an apparatus or component of an apparatus, or method in using an apparatus to address each and every problem sought to be solved by the present disclosure, for it to be encompassed by the present claims. Furthermore, no element, component, or method step in the present disclosure is intended to be dedicated to the public regardless of whether the element, component, or method step is explicitly recited in the claims. No claim element is intended to invoke 35 U.S.C. 112(f) unless the element is expressly recited using the phrase "means for." As used herein, the terms "comprises", "comprising", or any other variation thereof, are intended to cover a non-exclusive inclusion, such that a chemical, chemical composition, process, method, article, or apparatus that comprises a list of elements does not include only those elements but may include other elements not expressly listed or inherent to such chemical, chemical composition, process, method, article, or apparatus.

What is claimed is:

1. A method for enhanced recovery of a metal value from a metal-bearing material, comprising:

defining a plurality of regions within the metal-bearing material;

applying a first amount of a heated leaching solution to a first region of the metal-bearing material comprising the metal value, wherein the first amount of the heated leaching solution is heated using an external heat source to a temperature above an ambient temperature of the first region of the metal-bearing material, wherein application of the first amount of the heated leaching solution elevates the temperature of the metal-bearing material in an area that comprises the first region to a temperature that is greater than the sum of the ambient temperature of the area that comprises the first region of the metal-bearing material and an anticipated amount of heat generated from a chemical reaction between the first amount of the heated leaching solution and the first region of the metal-bearing material;

waiting for a first period of time, wherein, during the first period of time at least a portion of the metal value in the first region of the metal-bearing material is leached into the first amount of the heated leaching solution to create a first amount of a pregnant leaching solution, wherein during the first period of time heated leaching solution is applied to at least one other region of the metal-bearing material, wherein no additional heated leaching solution is applied to the first region of the metal-bearing material during the first period of time;

and wherein the total amount of metal value contained in collected portions of the pregnant leaching solution is greater than that collected from a first region of metal-bearing material comprising an equivalent metal value that is exposed to a leaching solution that is not heated to the temperature of the first amount of heated leaching solution, thereby enhancing recovery of the metal value.

2. The method of claim 1, wherein a metal of the metal-bearing material is copper.

3. The method of claim 1, further comprising measuring an amount of the metal value within the pregnant leaching solution.

4. The method of claim 3, further comprising applying an additional amount of heated leaching solution to the first region of the metal-bearing material when a concentration of less than 1 gram per liter of the metal value within the pregnant leaching solution is measured.

5. The method of claim 1, further comprising applying a second amount of a heated leaching solution to a second region of the metal-bearing material comprising the metal value, wherein the second amount of the heated leaching solution is heated using an external heat source to a temperature above an ambient temperature of the second region of the metal-bearing material, wherein application of the second amount of the heated leaching solution elevates the temperature of the metal-bearing material in an area that comprises the second region to a temperature that is greater than the sum of the ambient temperature of the area that comprises the second region of the metal-bearing material and an anticipated amount of heat generated from a chemical reaction between the second amount of the heated leaching solution and the second region of the metal-bearing material;

waiting for a second period of time, wherein during the second period of time heated leaching solution is applied to at least one other region of the metal-bearing material, wherein, during the second period of time at least a portion of the metal value in the second region of the metal-bearing material is leached into the second amount of the heated leaching solution to create a second amount of pregnant leaching solution, wherein no additional heated leaching solution is applied to the second region of the metal-bearing material during the second period of time;

collecting at least a portion of the first amount of pregnant leaching solution and the second amount of pregnant leaching solution and optionally combining the first amount and the second amount collected; and wherein the total amount of metal value contained in collected portions of the first and second pregnant leaching solutions is greater than that collected from a first and second region of metal-bearing material comprising an equivalent metal value that is exposed to a leaching solution that is not heated to the temperature of the first or the second amounts of heated leaching solution, thereby enhancing recovery of the metal value.

6. The method of claim 1, wherein the first amount of heated leaching solution is applied to the first region of the metal-bearing material for a plurality of days.

7. The method of claim 1, wherein the first period of time is 30 days.

8. The method of claim 1, wherein the first amount of heated leaching solution is heated to a temperature between 40° C. and 50° C. via an external heating source.

9. The method of claim 1, wherein the heated leaching solution comprises a leaching beneficial reagent.

10. The method of claim 5, wherein the second amount of heated leaching solution is applied to the second region of the metal-bearing material for a plurality of days.

11. The method of claim 5, wherein the second period of time is 30 days.

12. The method of claim 5, wherein the second amount of heated leaching solution is heated to a temperature between 40° C. and 50° C. via an external heating source.

13. The method of claim 5, wherein the first region of the metal-bearing material and the second region of the metal-bearing material are contained within a heap comprising the metal-bearing material.

14. The method of claim 5, wherein the first region of the metal-bearing material and the second region of the metal-bearing material overlap within a heap comprising the metal-bearing material.

15. The method of claim 5, wherein the first region of the metal-bearing material and the second region of the metal-bearing material are separated within a heap comprising the metal-bearing material.

16. The method of claim 5, wherein the first region of the metal-bearing material and the second region of the metal-bearing material are adjacent within a heap comprising the metal-bearing material.

17. The method of claim 16, wherein the first region of the metal-bearing material and the second region of the metal-bearing material are longitudinally arranged along a length or a width of the heap.

18. The method of claim 17, wherein heated leaching solution is successively applied to the longitudinally arranged first region of the metal-bearing material and then to the second region of the metal-bearing material.

19. A method for enhanced recovery of a metal value from a metal-bearing material, comprising:

defining a plurality of regions within the metal-bearing material;

applying a first amount of a heated leaching solution to a first region of the metal-bearing material comprising the metal value, wherein the first amount of the heated leaching solution is heated using an external heat source to a temperature above an ambient temperature of the first region of the metal-bearing material, wherein application of the first amount of the heated leaching solution elevates the temperature of the metal-bearing material in an area that comprises the first region to a temperature that is greater than the sum of the ambient temperature of the area that comprises the first region of the metal-bearing material and an anticipated amount of heat generated from a chemical reaction between the first amount of the heated leaching solution and the first region of the metal-bearing material;

waiting for a period of time between about 30 and about 60 days, wherein, during the period of time at least a portion of the metal value in the first region of the metal-bearing material is leached into the first amount of the heated leaching solution to create a first amount of a pregnant leaching solution, wherein during the period of time heated leaching solution is applied to at least one other region of the metal-bearing material, wherein no additional heated leaching solution is applied to the first region of the metal-bearing material during the period of time; and wherein the total amount of metal value contained in collected portions of the pregnant leaching solution is greater than that collected from a first region of metal-bearing material comprising an equivalent metal value that is exposed to a leaching solution that is not heated to the temperature of the first amount of heated leaching solution, thereby enhancing recovery of the metal value.

20. A method for enhanced recovery of a metal value from a metal-bearing material, comprising:

defining a plurality of regions within the metal-bearing material;

applying a first amount of a heated leaching solution to a first region of the metal-bearing material comprising the metal value, wherein the first amount of the heated leaching solution is heated using an external heat source to a temperature between about 40° C. and about 50° C., wherein the first amount of heated leaching solution is applied over a period time of about 30 to about 60 days at a rate of between about 5 liters per hour per square meter and about 10 liters per hour per square meter, wherein application of the first amount of the heated leaching solution elevates the temperature of the metal-bearing material in an area that comprises the first region to a temperature that is greater than the sum of an ambient temperature of the area that comprises the first region of the metal-bearing material and an anticipated amount of heat generated from a chemical reaction between the first amount of the heated leaching solution and the first region of the metal-bearing material;

terminating application of the heated leaching solution to the first region of the metal-bearing material;

waiting for a period of time between about 30 and about 60 days, wherein no additional heated leaching solution is applied to the first region of the metal-bearing material during the period of time;

wherein during the period of time heated leaching solution is applied to at least one other region of the metal-bearing material, wherein, during the application and waiting periods, at least a portion of the metal value in the first region of the metal-bearing material is leached into the first amount of the heated leaching solution to create a pregnant leaching solution, optionally repeating the application, termination, and waiting steps a plurality of times; and collecting the pregnant leaching solution, wherein the total amount of metal value contained in collected portions of the pregnant leaching solution is greater than that collected from a first region of metal-bearing material comprising an equivalent metal value that is exposed to a leaching solution that is not heated to the temperature of the first amount of heated leaching solution, thereby enhancing recovery of the metal value and/or wherein energy and reagent expenditure is less than energy and reagent expenditure realized when heated leaching solution is constantly applied to the metal-bearing material for an equivalent period of time.

* * * * *